US008903535B2

(12) United States Patent
Naka

(10) Patent No.: US 8,903,535 B2
(45) Date of Patent: Dec. 2, 2014

(54) SEWING MACHINE AND NON-TRANSITORY COMPUTER-READABLE MEDIUM

(71) Applicant: Takafumi Naka, Ama (JP)

(72) Inventor: Takafumi Naka, Ama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/050,955

(22) Filed: Oct. 10, 2013

(65) Prior Publication Data

US 2014/0116310 A1 May 1, 2014

(30) Foreign Application Priority Data

Oct. 30, 2012 (JP) ..... 2012-238554

(51) Int. Cl.
*D05B 19/16* (2006.01)
*D05B 19/08* (2006.01)
*D05B 21/00* (2006.01)

(52) U.S. Cl.
CPC ..... *D05B 19/08* (2013.01); *D05B 21/00* (2013.01); *D05B 19/16* (2013.01)
USPC ..... 700/137

(58) Field of Classification Search
CPC ..... D05B 3/04; D05B 19/00; D05B 19/16; D05B 21/002; D05B 27/06; D05B 21/00; D05B 19/08
USPC ..... 700/136–138
See application file for complete search history.

(56) References Cited

U.S. PATENT DOCUMENTS

| | | | | | |
|---|---|---|---|---|---|
| 2,513,343 | A | * | 7/1950 | Maxson | 112/235 |
| 2,907,291 | A | * | 10/1959 | Schrader | 112/318 |
| 3,094,089 | A | * | 6/1963 | Shuman | 112/235 |
| 3,754,519 | A | * | 8/1973 | Howell | 112/235 |
| 4,010,701 | A | * | 3/1977 | Helfont | 112/470.07 |
| 4,311,106 | A | * | 1/1982 | Hanneman | 112/313 |
| 4,417,535 | A | * | 11/1983 | Hannemann | 112/304 |
| 4,644,886 | A | * | 2/1987 | Miyakawa | 112/475.16 |
| 4,898,110 | A | * | 2/1990 | Nomura et al. | 112/470.03 |
| 4,909,165 | A | * | 3/1990 | Bozoglou | 112/470.31 |
| 5,289,788 | A | * | 3/1994 | Fukumoto | 112/470.03 |
| 5,313,901 | A | * | 5/1994 | Fujii | 112/320 |
| 5,383,418 | A | * | 1/1995 | Block et al. | 112/304 |
| 5,497,720 | A | * | 3/1996 | Kawasaki | 112/153 |
| 5,687,660 | A | * | 11/1997 | Honda et al. | 112/470.03 |

(Continued)

FOREIGN PATENT DOCUMENTS

JP A-5-7681 1/1993

*Primary Examiner* — Danny Worrell
(74) *Attorney, Agent, or Firm* — Oliff PLC

(57) ABSTRACT

A sewing machine includes a bed, a sewing machine motor, a drive shaft, a needle bar moved up and down by the rotation of the drive shaft, a first feed mechanism can move the sewing object by making contact from below, a maximum value of the unit feed amount for the first feed mechanism being less than a specified length that is the length of a basting stitch, a second feed mechanism can move the sewing object by making contact from above, a maximum value of the unit feed amount for the second feed mechanism being not less than the specified length, and a control device controls the first feed mechanism such that the first feed mechanism does not move the sewing object and controls the second feed mechanism such that the second feed mechanism moves the sewing object with the specified length being defined as the unit feed amount.

6 Claims, 6 Drawing Sheets

(56) References Cited

U.S. PATENT DOCUMENTS

| | | | | |
|---|---|---|---|---|
| 5,690,040 | A * | 11/1997 | Nakayama et al. | 112/235 |
| 5,701,833 | A * | 12/1997 | Suzuki | 112/475.16 |
| 6,123,039 | A * | 9/2000 | Niino | 112/235 |
| 6,431,098 | B2 * | 8/2002 | Asazuma et al. | 112/235 |
| 6,748,889 | B2 * | 6/2004 | Martelli et al. | 112/235 |
| 7,430,974 | B2 * | 10/2008 | Sho et al. | 112/470.33 |
| 7,983,780 | B2 | 7/2011 | Hirose | |
| 8,573,145 | B2 * | 11/2013 | Dickerson | 112/470.02 |
| 2001/0050037 | A1 * | 12/2001 | Asazuma et al. | 112/235 |
| 2012/0060735 | A1 * | 3/2012 | Dickerson | 112/313 |

* cited by examiner

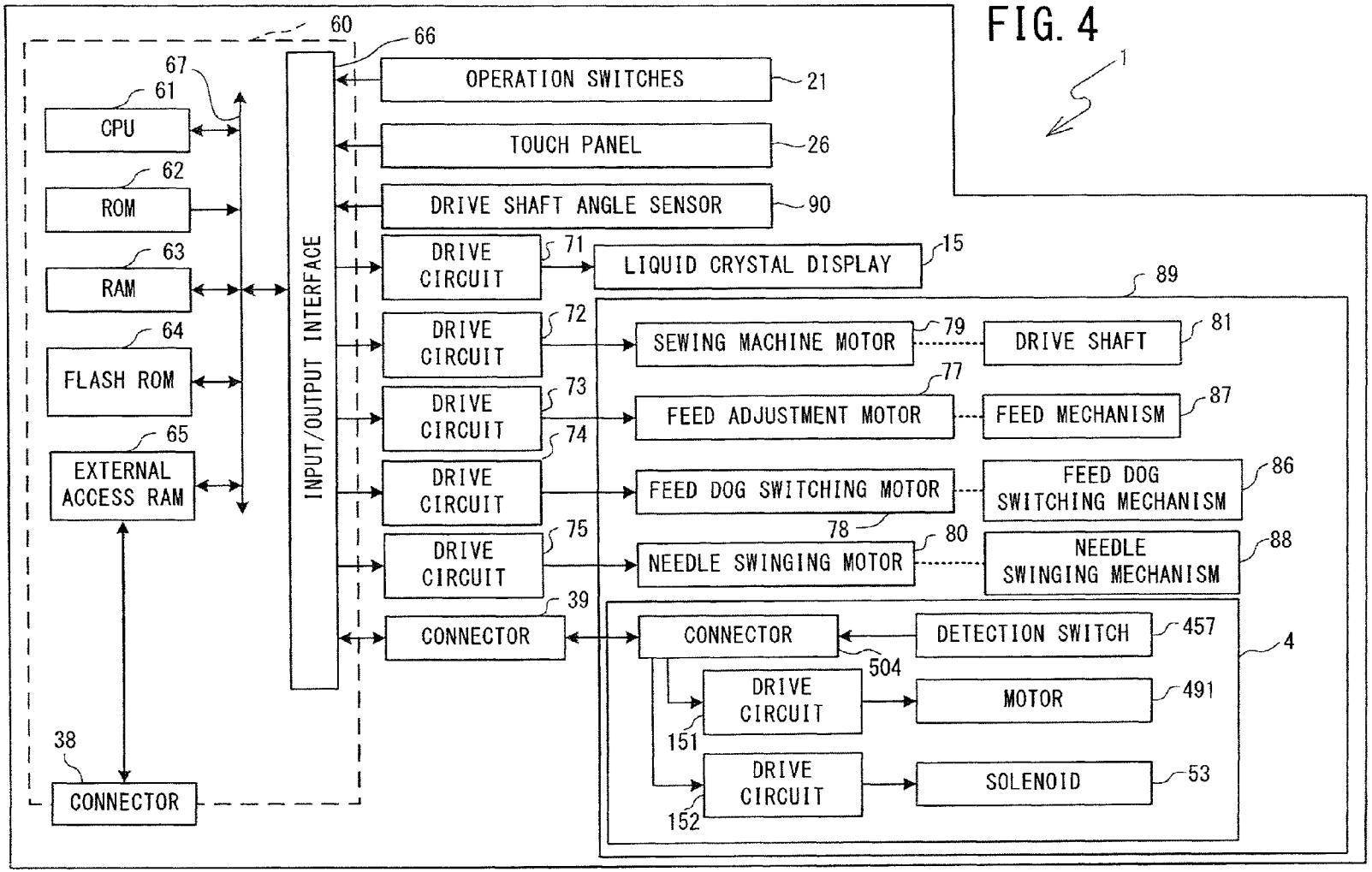
FIG. 4
1
OPERATION SWITCHES
21
TOUCH PANEL
26
DRIVE SHAFT ANGLE SENSOR
90
LIQUID CRYSTAL DISPLAY
15
DRIVE CIRCUIT
71
DRIVE CIRCUIT
72
DRIVE CIRCUIT
73
DRIVE CIRCUIT
74
DRIVE CIRCUIT
75
CONNECTOR
39
66
60
INPUT/OUTPUT INTERFACE
67
CPU
61
ROM
62
RAM
63
FLASH ROM
64
EXTERNAL ACCESS RAM
65
CONNECTOR
38
89
SEWING MACHINE MOTOR
79
DRIVE SHAFT
81
FEED ADJUSTMENT MOTOR
77
FEED MECHANISM
87
FEED DOG SWITCHING MOTOR
78
FEED DOG SWITCHING MECHANISM
86
NEEDLE SWINGING MOTOR
80
NEEDLE SWINGING MECHANISM
88
4
CONNECTOR
504
DETECTION SWITCH
457
DRIVE CIRCUIT
151
MOTOR
491
DRIVE CIRCUIT
152
SOLENOID
53

SEWING MACHINE AND NON-TRANSITORY COMPUTER-READABLE MEDIUM

CROSS-REFERENCE TO RELATED APPLICATION

This application claims priority to Japanese Patent Application No. 2012-238554, filed Oct. 30, 2012, the content of which is hereby incorporated herein by reference in its entirety.

BACKGROUND

The present disclosure relates to a sewing machine that is capable of forming a basting stitch and to a non-transitory computer-readable medium.

A sewing machine is known that it is provided with a function that forms a basting stitch. Basting stitches are formed to temporarily tack two sewing objects (work cloths) together, for example, and they are removed after the lock stitches have been formed. Therefore, the length of a basting stitch is ordinarily set to be longer than the length of a single lock stitch. The length of a single lock stitch is equivalent to a feed amount by which a feed dog moves the sewing object in a single cycle. Accordingly, in the known sewing machine, the sewing object is moved by operating the feed dog for a plurality of cycles while a needle bar releasing mechanism temporarily halts up-down movement of a needle bar, such that a basting stitch is sewn that is longer than the feed amount by which the feed dog moves the sewing object in a single cycle.

SUMMARY

In order to form one basting stitch, the known sewing machine that is described above must use the needle bar releasing mechanism to temporarily halt the up-down movement of the needle bar and must operate the feed dog for a plurality of cycles. In other words, in order for one basting stitch to be formed, a drive shaft must be driven for a plurality of revolutions. Therefore, in the known sewing machine, the time that is required for forming one basting stitch is longer than the time that is required for forming one lock stitch, which is formed by driving the drive shaft through one revolution.

Embodiments of the broad principles derived herein provide a sewing machine that is capable of shortening the sewing time for a basting stitch whose length is greater than the feed amount by which the feed dog moves the sewing object in a single cycle, and also provide a non-transitory computer-readable medium.

Embodiments provide a sewing machine includes a bed, a sewing machine motor, a drive shaft, a needle bar, a first feed mechanism, a second feed mechanism, and a control device. The drive shaft is configured to be rotated by the sewing machine motor. The needle bar is configured to be moved up and down by the rotation of the drive shaft and on a lower end of which a sewing needle is able to be mounted. The first feed mechanism, by making contact from below with a sewing object that has been placed on the bed, is able to move the sewing object, the amount for which the sewing object is moved per revolution of the drive shaft in a case where the sewing object is moved in synchronization with the rotation of the drive shaft being a unit feed amount, and a maximum value of the unit feed amount for the first feed mechanism being less than a specified length that is the length of a basting stitch. The second feed mechanism, by making contact from above with the sewing object that has been placed on the bed, is able to move the sewing object, a maximum value of the unit feed amount for the second feed mechanism being not less than the specified length. The control device is configured to acquire a command to form a basting stitch, and in a case where the control device has acquired the command, to control the first feed mechanism such that the first feed mechanism does not perform moving of the sewing object and to control the second feed mechanism such that the second feed mechanism performs moving of the sewing object in synchronization with the rotation of the drive shaft, with the specified length being defined as the unit feed amount.

Embodiments also provide a sewing machine includes a bed, a sewing machine motor, a drive shaft, a needle bar, a feed mechanism, a control device. The drive shaft is configured to be rotated by the sewing machine motor. The needle bar is configured to be moved up and down by the rotation of the drive shaft and on a lower end of which a sewing needle is able to be mounted. The feed mechanism, by making contact from above with a sewing object that has been placed on the bed, is able to move the sewing object. The control device is configured to acquire a command to form a basting stitch, and in a case where the control device has acquired the command, to control the feed mechanism such that the feed mechanism moves the sewing object in synchronization with the rotation of the drive shaft, with the length of the basting stitch being defined as a unit feed amount that is the amount for which the sewing object is moved per revolution of the drive shaft.

Embodiments further provide non-transitory computer-readable medium storing computer-readable instructions. The instructions cause a processor to execute steps including, acquiring a command to form a basting stitch, and controlling a first feed mechanism and a second feed mechanism, in a case where the processor has acquired the command, such that the first feed mechanism does not perform moving of a sewing object that has been placed on a bed and the second feed mechanism performs moving of the sewing object, with a specified length that is the length of the basting stitch being defined as a unit feed amount, the unit feed amount being, in a case where the sewing object is moved in synchronization with the rotation of a drive shaft, the amount for which the sewing object is moved per revolution of the drive shaft, the drive shaft being rotated by a sewing machine motor and its rotation moving a needle bar, on a lower end of which a sewing needle is able to be mounted, up and down, the first feed mechanism being a feed mechanism that is able to move the sewing object by making contact with the sewing object from below, a maximum value of the unit feed amount for the first feed mechanism being less than the specified length, the second feed mechanism being a feed mechanism that is able to move the sewing object by making contact with the sewing object from above, and a maximum value of the unit feed amount for the second feed mechanism being not less than the specified length.

BRIEF DESCRIPTION OF THE DRAWINGS

Embodiments will be described below in detail with reference to the accompanying drawings in which:

FIG. 4 is a block diagram that shows an electrical configuration of the sewing machine 1;

DETAILED DESCRIPTION

Hereinafter, an embodiment that is a specific example of the present disclosure will be explained with reference to the drawings. Note that the drawings are used for explaining technological features that the present disclosure can utilize and do not serve to restrict the content of the present disclosure. The present embodiment is an example of a case in which the present disclosure is applied to a sewing machine that forms a stitch in a sewing object (for example, a work cloth).

Figure 1:
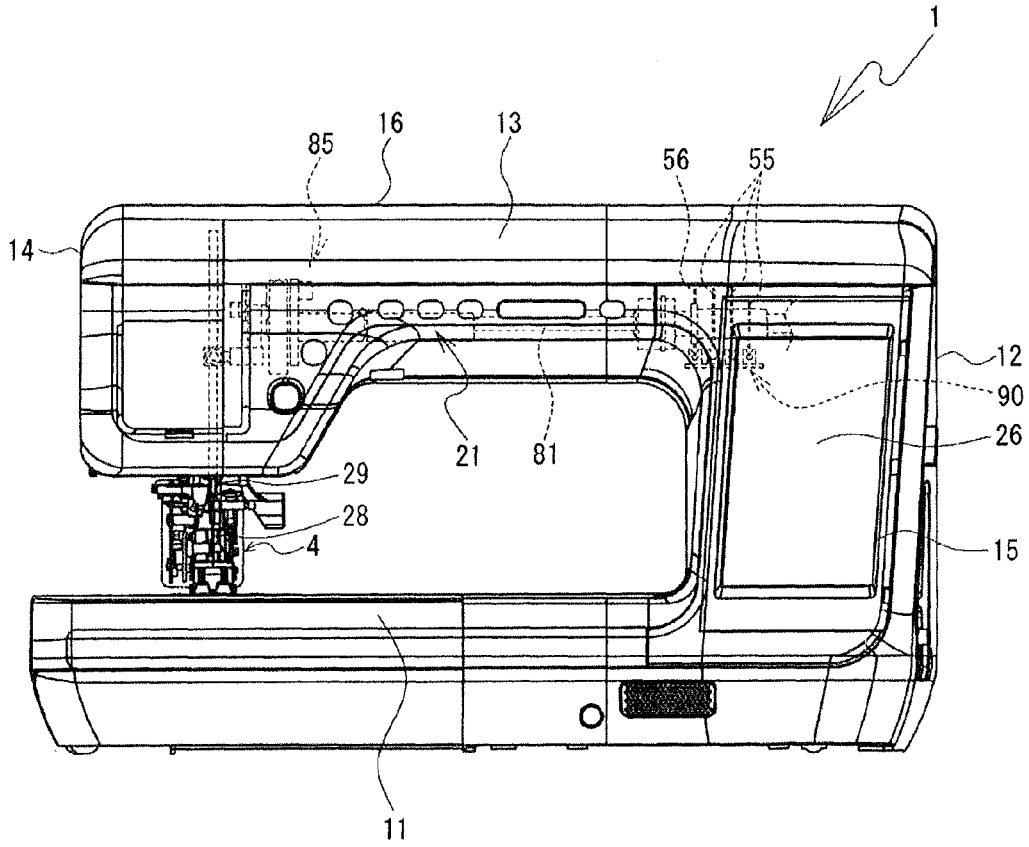
FIG. 1 is a front view of a sewing machine 1.

First, a physical configuration of a sewing machine 1 will be explained with reference to FIGS. 1 to 3. In the explanation that follows, the front side, the rear side, the top side, the bottom side, the left side, and the right side in FIG. 1 are explained as respectively defining the front side, the rear side, the top side, the bottom side, the left side, and the right side of the sewing machine 1. In other words, the face of the sewing machine 1 on which a plurality of operation switches 21 are disposed is the front face. The longer dimensions of a bed 11 and an arm 13 extend in the left-right direction of the sewing machine 1, and the side on which a pillar 12 is provided is the right side. The direction in which the pillar 12 extends is the up-down direction of the sewing machine 1.

The sewing machine 1 is provided with the bed 11, the pillar 12, and the arm 13. The bed 11 is the base portion of the sewing machine 1, and it extends in the left-right direction. The pillar 12 extends upward from the right end of the bed 11. The arm 13 extends to the left from the top of the pillar 12 and faces the bed 11. The left end of the arm 13 is a head 14.

A needle plate 33 (refer to FIG. 3) is provided on the top face of the bed 11. Underneath the needle plate 33 (that is, inside the bed 11), a feed dog 34 (refer to FIG. 3), a feed mechanism 87 (refer to FIG. 4), a feed dog switching mechanism 86 (refer to FIG. 4), a shuttle mechanism (not shown in the drawings), a feed adjustment motor 77 (refer to FIG. 4), and a feed dog switching motor 78 (refer to FIG. 4) are provided as structural elements of a sewing mechanism 89 (refer to FIG. 4). The sewing mechanism 89 is a mechanism that forms a stitch in a sewing object 100. The feed dog 34 is driven by the feed mechanism 87 in synchronization with the rotation of a drive shaft 81, which will be described later, and it moves the sewing object 100 by a specified feed amount. The feed amount of the feed dog 34 is adjusted by the feed adjustment motor 77. The feed dog switching mechanism 86 is a mechanism that switches the feed dog 34 between a first feed-enabled state and a first standby state. The first feed-enabled state is a state in which the feed dog 34 is able to move the sewing object 100. The first standby state is a state in which the feed dog 34 does not move the sewing object 100. The feed dog switching mechanism 86 switches the state of the feed dog 34, using the feed dog switching motor 78 as a drive source. The configuration of the feed dog switching mechanism 86 and the operations that switch the state of the feed dog 34 are known, having been disclosed in the specification of U.S. Pat. No. 7,983,780 and the like, so detailed explanations will be omitted. The shuttle mechanism intertwines an upper thread with a lower thread underneath the needle plate 33.

A liquid crystal display (hereinafter called the LCD) 15 is provided on the front face of the pillar 12. An image that includes various types of items, such as commands, illustrations, setting values, messages, and the like, is displayed on the LCD 15. A touch panel 26 is provided on the front face of the LCD 15. When a user uses a finger, a special touch pen, or the like to perform a pressing operation (hereinafter called a panel operation) on the touch panel 26, the position that is pressed is detected by the touch panel 26, and the item that has been selected is recognized accordingly. The user is able to use a panel operation of this sort to select a stitch pattern to be sewn or a command to be executed.

A connector 38 (refer to FIG. 4) is provided on the right side face of the pillar 12. An external storage device (not shown in the drawings) such as a memory card or the like can be connected to the connector 38. The sewing machine 1 can acquire stitch pattern data, as well as various types of programs, from the external storage device that is connected to the connector 38. The stitch pattern data are data for sewing utility stitch patterns. The stitch pattern data in the present embodiment include coordinate data. The coordinate data are data that describe the relative coordinates of a needle drop point for a unit stitch. A unit stitch is a stitch that that indicates the smallest structural unit of a utility stitch pattern. A needle drop point is the point where a sewing needle 28 pierces the sewing object 100 when a needle bar 29 is moved downward from a state in which the sewing needle 28 is above the sewing object 100.

A cover 16 that can be opened and closed is provided in the upper portion of the arm 13. Note that the cover 16 is in a closed state in FIG. 1. A spool containing portion (not shown in the drawings) is provided under the cover 16, that is, in the interior of the arm 13. The spool containing portion is provided with a thread spool pin (not shown in the drawings) that extends in the left-right direction. A thread spool (not shown in the drawings) is accommodated in the spool containing portion in a state in which the thread spool pin has been inserted into the thread spool. The upper thread (not shown in the drawings), which is wound around the thread spool, is supplied from the thread spool to the sewing needle 28, which is mounted on the needle bar 29, by way of a thread guard portion (not shown in the drawings) that is provided in the head 14. The plurality of the operation switches 21, which include a start-and-stop switch, are provided in the lower portion of the front face of the arm 13. A connector 39 (refer to FIG. 4) is provided on the rear face of the arm 13. An upper feed device 4, which will be described later, is connected to the connector 39.

The drive shaft 81 and a sewing machine motor 79 (refer to FIG. 4) are provided inside the arm 13 and the pillar 12. The drive shaft 81 extends in the left-right direction and is rotationally driven by the sewing machine motor 79. A rotating shutter 55 and an encoder disc 56 are provided near the right end of the drive shaft 81. The rotating shutter 55 is made up of a plurality of fan-shaped masking plates. A plurality of narrow slits are formed in the encoder disc 56. The rotating of the rotating shutter 55 and the encoder disc 56 is detected optically by a drive shaft angle sensor 90. The drive shaft angle sensor 90 is a sensor that monitors the rotation angle and the revolution speed of the drive shaft 81, and it is provided in the sewing machine casing (not shown in the drawings). By using the drive shaft angle sensor 90 to detect the rotation angle and the revolution speed of the drive shaft 81, the sewing machine 1 is able to set the timing and the feed velocity at which the sewing object 100 is moved by the upper feed device 4. This will be described in detail later.

The needle bar 29, a presser bar 27, a needle bar mechanism 85, a needle swinging mechanism 88 (refer to FIG. 4), and a needle swinging motor 80 (refer to FIG. 4) are provided in the head 14 as structural elements of the sewing mechanism 89 (refer to FIG. 4). The needle bar 29 and the presser bar 27 extend downward from the bottom edge of the head 14. The sewing needle 28 is replaceably mounted on the lower end of the needle bar 29. The upper feed device 4 is removably attached to the lower end of the presser bar 27 and moves the sewing object 100 one of independently and in coordination with the feed dog 34. The upper feed device 4 is a structural element of the sewing mechanism 89 and disposed higher than the bed 11. The upper feed device 4 will be described in detail below with reference to FIGS. 2 and 3. The needle bar mechanism 85 moves the needle bar 29 up and down. The needle bar mechanism 85 is driven by the drive shaft 81. The needle swinging mechanism 88 swings the needle bar 29 to the left and to the right. The needle swinging mechanism 88 is driven by the needle swinging motor 80.

The upper feed device 4 will be explained with reference to FIGS. 2 and 3. As shown in FIGS. 2 and 3, the upper feed device 4 is mainly provided with a housing 41, a mounting portion 42, a feed mechanism 43, a drive mechanism 44, a switching mechanism 45, a pressure adjustment mechanism 48, a connecting portion 52, and a presser foot 51. These structural elements of the upper feed device 4 will now be explained.

The housing 41 is approximately a rectangular parallel piped shape, and in its interior it contains the mounting portion 42, a part of the feed mechanism 43, the drive mechanism 44, the switching mechanism 45, and a part of the pressure adjustment mechanism 48. The mounting portion 42 is a portion by which the upper feed device 4 is removably mounted on the presser bar 27 of the sewing machine 1. The mounting portion 42 is the front end portion of the upper feed device 4, and it is provided on the upper side of the feed mechanism 43. The mounting portion 42 is provided with two holding portions 421, 422 and a screw 423. The holding portions 421, 422 have shapes that are recessed toward the left. The screw 423 screws into a threaded hole (not shown in the drawings) that is provided in the lower end of the presser bar 27 and extends through the presser bar 27 in the left-right direction. The upper feed device 4 is removably mounted on the presser bar 27 by screwing the screw 423 into the threaded hole in the presser bar 27 in a state in which the lower end of the presser bar 27 has been positioned in the recessed portions of the holding portions 421, 422. In a case where the presser bar 27 moves upward, the upper feed device 4 also moves upward, and the presser foot 51 moves away from the sewing object 100. In a case where the presser bar 27 moves downward, the upper feed device 4 also moves downward, and the presser foot 51 is enabled to presses downward on the sewing object 100.

The feed mechanism 43 is a mechanism that is capable of moving the sewing object 100, which has been placed on the bed 11, by coming into contact with the sewing object 100 from above. The feed mechanism 43 is provided with plate portions 431, 432, a first pulley 433, a second pulley 434, and a belt 435. As shown in FIG. 2, the plate portions 431, 432 are positioned opposite one another on the right and left sides, respectively, of the feed mechanism 43. As shown in FIG. 3, the rear end portions of the plate portions 431, 432 support the first pulley 433 such that it can rotate. The front end portions of the plate portions 431, 432 support the second pulley 434 such that it can rotate. The belt 435 is installed around the first pulley 433 and the second pulley 434, and it is driven in conjunction with the rotation of the first pulley 433. As shown in FIGS. 2 and 3, the second pulley 434 is positioned at a belt positioning portion 512 (described later) of the presser foot 51. The manner in which the position of the feed mechanism 43 is switched by the switching mechanism 45 will be described later.

The drive mechanism 44 is a mechanism that drives the feed mechanism 43. The drive mechanism 44 is provided with a motor 491 and a plurality of gears (not shown in the drawings) that include a drive gear (not shown in the drawings). The motor 491 is the power source for the feed mechanism 43, and a drive shaft (not shown in the drawings) of the motor 491 is provided such that it extends in the left-right direction. The drive gear is affixed to one end of the drive shaft of the motor 491, and the rotation of the drive gear is transmitted to the first pulley 433 through the other gears. In other words, when the motor 491 turns, the first pulley 433 is rotated through the plurality of the gears. When the first pulley 433 rotates, the belt 435 is driven (moved rotationally). The second pulley 434 is rotated in conjunction with the driving of the belt 435. The second pulley 434 presses against the sewing object 100 through the belt 435. The belt 435 moves the sewing object 100 by moving rotationally while in contact with the sewing object 100 from above.

The switching mechanism 45 is a mechanism that, by controlling the position of the feed mechanism 43, switches the upper feed device 4 between a second feed-enabled state and a second standby state. The second feed-enabled state is a state in which the sewing object 100 can be moved. In the present embodiment, the second feed-enabled state is a state in which the feed mechanism 43 is in contact with the sewing object 100 from above, as shown in the bottom half of FIG. 3, and the sewing object 100 can be moved. The second standby state is a state in which the sewing object 100 is not moved. In the present embodiment, the second standby state is a state in which the feed mechanism 43 has moved away from the sewing object 100, as shown in the top half of FIG. 3, and the sewing object 100 cannot be moved. The switching mechanism 45 is mainly provided with a base portion 451, a lever plate 452, a linking member 465, a spring 468, a rotating member 469, a rotating plate 471, a solenoid 53, and a detector switch 457.

The base portion 451 is a plate-shaped member that extends in the front-rear direction. The lever plate 452 is a plate-shaped member that, when viewed from the right side, has a shape like a letter U that has been rotated 90 degrees toward the front. The lever plate 452 is supported at the lower portion of its rear end by the base portion 451, such that the lever plate 452 is able to rotate with a shaft 459 as the center of rotation. A cylindrical portion 476 that projects toward the right is provided on the upper side of the front end portion of the lever plate 452. The linking member 465 is a plate member that has an elliptical shape in a right side view. One end of the linking member 465 is supported by the base portion 451 such that it can rotate about a shaft 467, and the other end of the linking member 465 is supported by the front end of the lower portion of the lever plate 452 such that it can rotate about a shaft 464. The spring 468 is provided such that it extends between the shaft 467 and the shaft 459, and it energizes the lever plate 452. The rotating member 469 is a member that is provided above the front end of the base portion 451, and it can rotate about a shaft 470. The feed mechanism 43 is coupled to the front end of the rotating member 469. The rotating plate 471 is a plate member that is coupled to the rear portion of the rotating member 469. When the rotating member 469 rotates about the shaft 470, the feed mechanism 43 and the rotating plate 471, which are coupled to the rotating member 469, also rotate.

Figure 2:
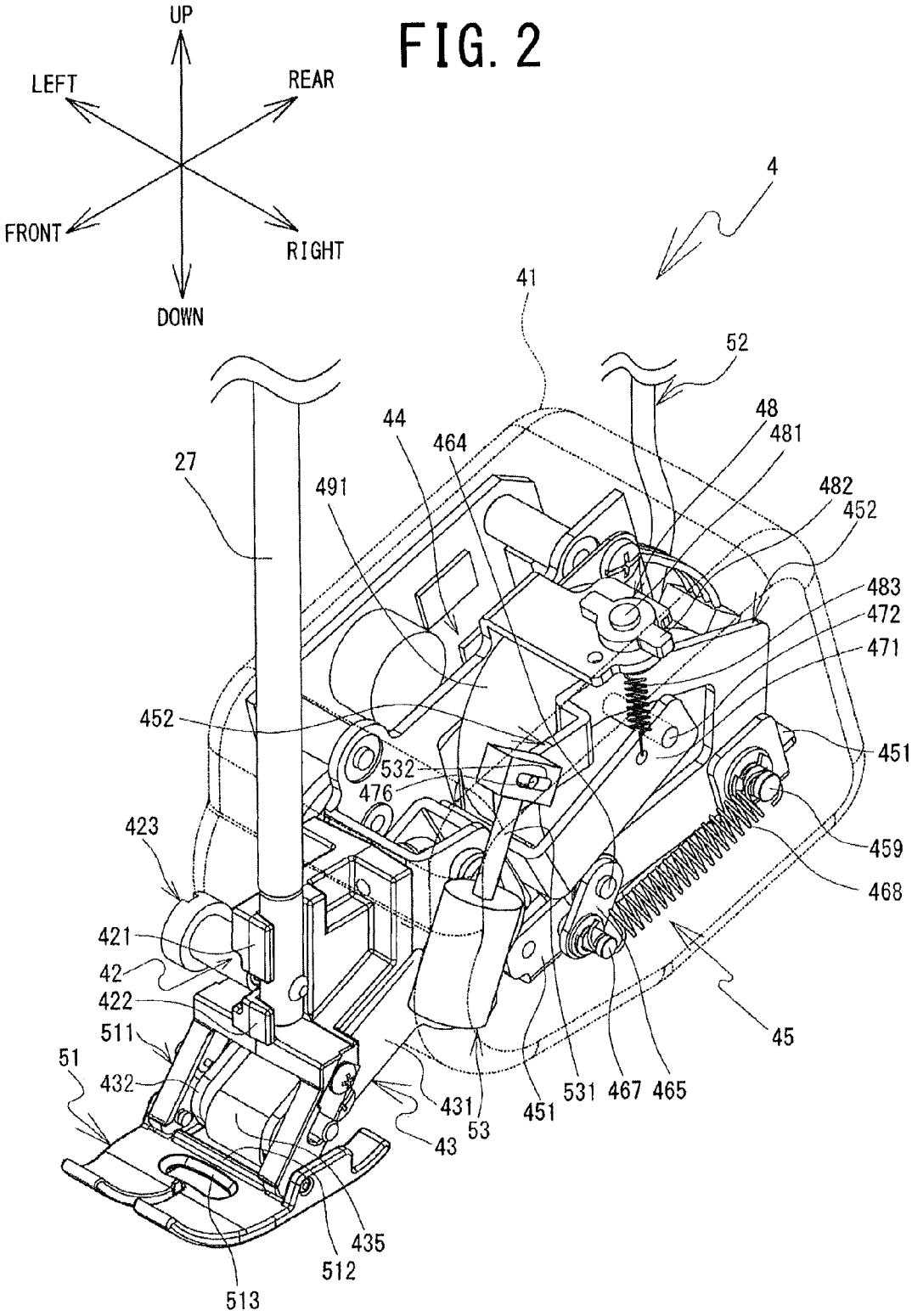
FIG. 2 is an oblique view of an upper feed device 4 in a case where the upper feed device 4 is in a second feed-enabled state.
Figure 3:
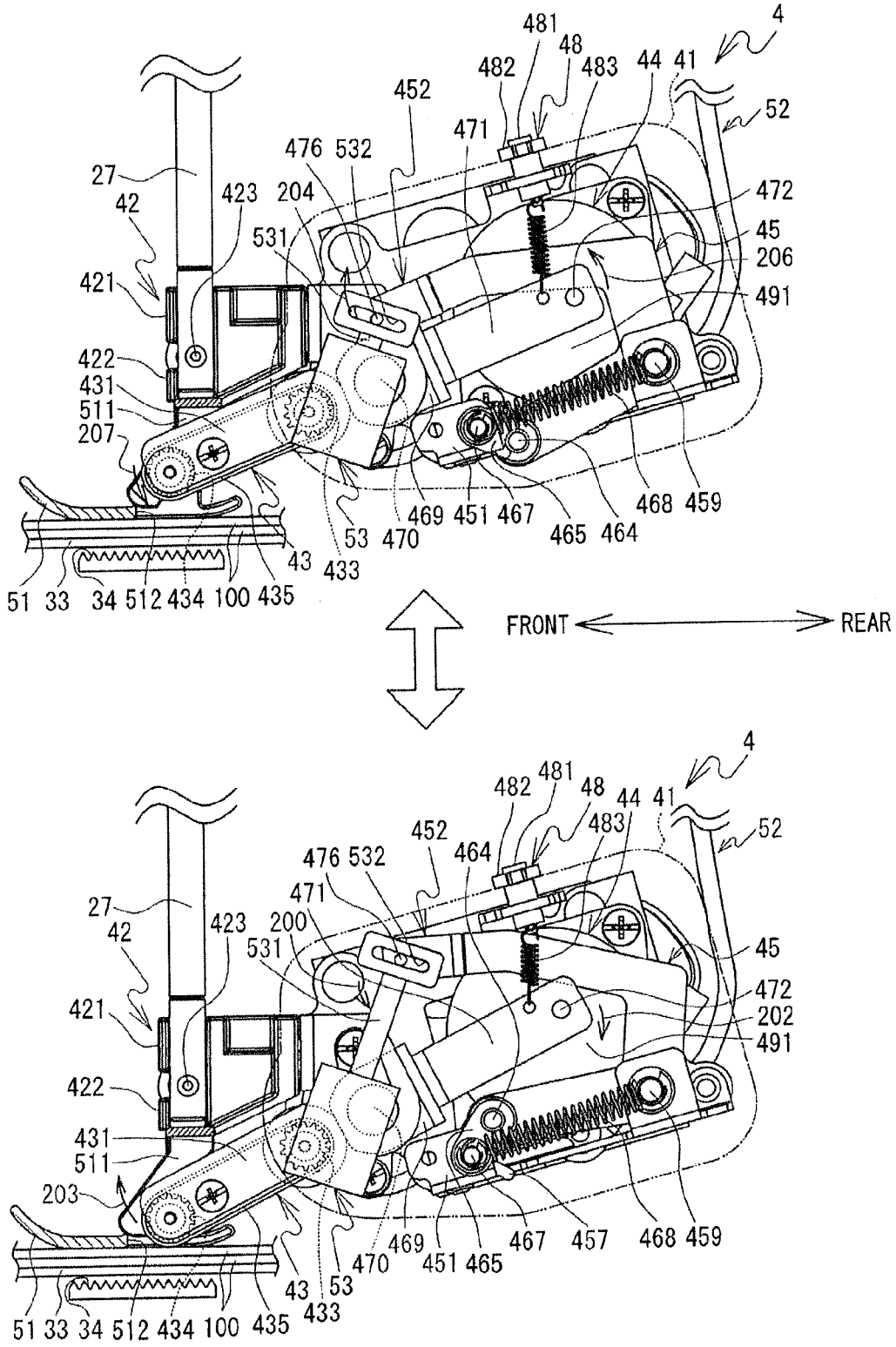
FIG. 3 is two right side views of the upper feed device 4, respectively showing a case where the upper feed device 4 is in a second standby state and the case where the upper feed device 4 is in the second feed-enabled state.

As shown in FIG. 2, the rear end portion of the rotating plate 471 is positioned to the right of the rear end portion of the lever plate 452. A shaft 472 that projects toward the left is formed on the rear end portion of the rotating plate 471. The shaft member 472 is positioned below the rear end portion of the lever plate 452. The solenoid 53 is the power source for the switching mechanism 45, and it rotates the lever plate 452 by moving the position of the upper front end portion of the lever plate 452. The solenoid 53 is operated based on a command from a control portion 60 of the sewing machine 1. The solenoid 53 includes a drive shaft 531 and a hole 532. The drive shaft 531 is provided such that it extends obliquely upward toward the rear. The hole 532 is formed in the upper end portion of the drive shaft 531. The cylindrical portion 476 of the lever plate 452 is engaged with the inside of the hole 532 such that the cylindrical portion 476 is able to slide within the hole 532. The detector switch 457 is a switch that, based on the state of rotation of the lever plate 452, detects whether the upper feed device 4 is in the second feed-enabled state or the second standby state. The detector switch 457 is provided on the upper side of the front end portion of the base portion 451. Operations in which the state of the upper feed device 4 is switched by the switching mechanism 45 will be described later.

The pressure adjustment mechanism 48 is a mechanism that adjusts the force with which the belt 435 of the feed mechanism 43 presses on the sewing object 100. The pressure adjustment mechanism 48 includes a male threaded portion 481, a female threaded portion 482, and a spring 483. One end of the spring 483 is affixed to the male threaded portion 481, and the other end is affixed to the rotating plate 471. When the user turns the female threaded portion 482, the male threaded portion 481 moves in the up-down direction, changing the energizing force of the spring 483, which is connected to the male threaded portion 481. The changing of the energizing force of the spring 483 changes the force with which the spring 483 pulls on the rear end portion of the rotating plate 471. The tilt of the feed mechanism 43, which is coupled to the rotating plate 471 through the rotating member 469, is thus changed, and the force with which the belt 435 presses against the sewing object 100 is adjusted.

The presser foot 51 is removably attached to the lower end of the presser bar 27, and the up-down movement of the presser bar 27 causes the presser foot 51 to press downward intermittently against the sewing object 100. The presser foot 51 is provided with a presser foot support portion 511, a belt positioning portion 512, and a hole 513. The presser foot support portion 511 straddles the front end portion of the feed mechanism 43 on the left and right, and it extends obliquely downward toward the front. The belt positioning portion 512 is provided on the rear edge side of the presser foot 51, and it is a rectangular portion that extends through the presser foot 51 in the up-down direction. The front end portion of the belt 435 of the feed mechanism 43 is disposed on the inner side of the belt positioning portion 512. The hole 513 is provided in the rear portion of the presser foot 51 and is an opening through which the sewing needle 28 passes. The connecting portion 52 electrically connects the upper feed device 4 to the control portion 60 (refer to FIG. 4) of the sewing machine 1. The connecting portion 52 is connected to the connector 39 (refer to FIG. 4).

The operations in which the switching mechanism 45 is controlled such that it switches the state of the upper feed device 4 will be explained with reference to FIG. 3. In a case where the upper feed device 4 is switched from the second standby state that is shown in the top half of FIG. 3 to the second feed-enabled state that is shown in the bottom half of FIG. 3, the sewing machine 1 controls the solenoid 53 such that it moves the drive shaft 531 obliquely upward toward the rear. When the drive shaft 531 moves obliquely upward toward the rear, the lever plate 452 rotates clockwise around the shaft 459. When the lever plate 452 rotates clockwise (refer to the arrow 204 in the top half of FIG. 3), the rear end portion of the lever plate 452 starts to move away from the shaft 472 of the rotating plate 471. The rotating plate 471 is pulled upward by the spring 483 of the pressure adjustment mechanism 48, so the rotating plate 471 rotates upward around the shaft 470 (refer to the arrow 206 in the top half of FIG. 3). Therefore, the feed mechanism 43, which is coupled to the rotating plate 471 through the rotating member 469, rotates downward around the shaft 470 (refer to the arrow 207 in the top half of FIG. 3). Thus the portion of the belt 435 that is disposed underneath the second pulley 434 comes into contact with the sewing object 100 from above and presses the sewing object 100 downward. In other words, the upper feed device 4 is switched to the second feed-enabled state. In a case where the upper feed device 4 is in the second feed-enabled state, the upper feed device 4 is able to move the sewing object 100 both independently and by operating in coordination with the feed dog 34. Note that the state in which the upper feed device 4 has been switched to the second feed-enabled state is maintained, because the contractive force of the spring 468 is constantly acting on the lever plate 452.

The operation in a case of switching from the second feed-enabled state to the second standby state is the reverse of the operation in a case where the upper feed device 4 is switched from the second standby state to the second feed-enabled state. The sewing machine 1 controls the solenoid 53 such that it moves the drive shaft 531 obliquely downward toward the front. When the drive shaft 531 moves obliquely downward toward the front, the lever plate 452 rotates counterclockwise. When the lever plate 452 rotates counterclockwise (refer to the arrow 200 in the bottom half of FIG. 3), the rear end portion of the lever plate 452 starts to come into contact with the shaft 472 of the rotating plate 471. The rotating plate 471 rotates downward around the shaft 470 (refer to the arrow 202 in the bottom half of FIG. 3) in opposition to the energizing force of the spring 483 of the pressure adjustment mechanism 48. The feed mechanism 43, which is coupled to the rotating plate 471 through the rotating member 469, rotates upward around the shaft 470 (refer to the arrow 203 in the bottom half of FIG. 3). Thus the portion of the belt 435 that is disposed underneath the second pulley 434 moves away from the sewing object 100, and the upper feed device 4 is switched from the second feed-enabled state to the second standby state.

The electrical configuration of the sewing machine 1 will be explained with reference to FIG. 4. The control portion 60 of the sewing machine 1 is provided with a CPU 61, a ROM 62, a RAM 63, a flash ROM 64, an external access RAM 65, and an input/output interface 66. The CPU 61, the ROM 62, the RAM 63, the flash ROM 64, the external access RAM 65, and the input/output interface 66 are electrically connected to one another through a bus 67. Various types of programs, including a program for the CPU 61 to perform main processing, which will be described later, are stored in the ROM 62, along with data and the like. A plurality of types of stitch pattern data are stored in the flash ROM 64, along with various types of parameters and the like for the CPU 61 to operate the upper feed device 4 in synchronization with the rotation of the drive shaft 81. The connector 38 is connected to the external access RAM 65.

The operation switches 21, the touch panel 26, the drive shaft angle sensor 90, drive circuits 71 to 75, and the connector 39 are electrically connected to the input/output interface 66. The drive circuits 71 to 75 respectively drive the LCD 15, the sewing machine motor 79, the feed adjustment motor 77, the feed dog switching motor 78, and the needle swinging motor 80. The upper feed device 4 can be connected to the connector 39. A circuit is provided in the connector 39 that detects the connection with the upper feed device 4. In a case where the upper feed device 4 is connected, the connector 39 inputs a low signal to the CPU 61, and in a case where the upper feed device 4 is not connected, the connector 39 inputs a high signal to the CPU 61.

The upper feed device 4 is provided with a connector 504, the detector switch 457, and drive circuits 151, 152. The connector 504 is electrically connected to the detector switch 457 and the drive circuits 151, 152. The drive circuit 151 drives the motor 491 based on a command that is output from the CPU 61. The drive circuit 152 drives the solenoid 53 based on a command that is output from the CPU 61. The detector switch 457 outputs a detection result (one of the second feed-enabled state and the second standby state) to the CPU 61.

Figure 5:
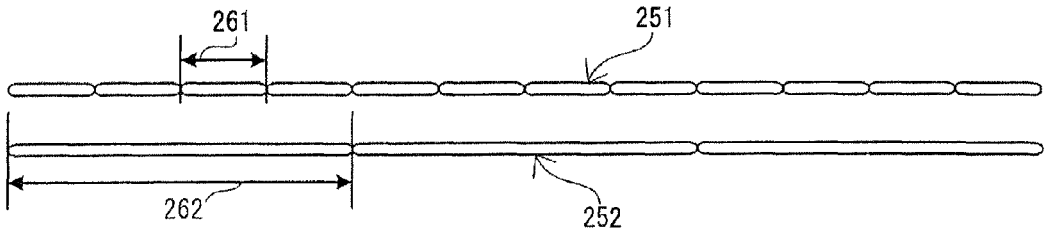
FIG. 5 is an explanatory figure of a basting stitch 252.

A basting stitch 252 will be explained with reference to FIG. 5. The basting stitch 252 is a stitch that is formed in order to temporarily tack two of the sewing objects 100 together, for example. In the sewing machine 1 of the present embodiment, a basting stitch pattern can be selected from among a plurality of types of utility stitch patterns. The basting stitch pattern is a stitch pattern for forming basting stitches. In the present embodiment, the basting stitch pattern is a straight line stitch pattern. In the present embodiment, a length L of the basting stitch (the length indicated by the arrow 262) is set to be longer than the maximum value of a unit feed amount for the feed dog 34. In a case where the sewing object 100 is moved in synchronization with the rotation of the drive shaft 81, the unit feed amount is the amount that the sewing object 100 is moved per revolution of the drive shaft 81. In the sewing machine 1 of the present embodiment, in a case where the sewing object 100 is moved from the front toward the rear, the maximum value of the unit feed amount for the feed dog 34 is defined as 5 millimeters. Therefore, the maximum length of a straight line stitch 251 that can be formed by using the feed dog 34 and not using a known needle bar releasing device (the length indicated by the arrow 261) is 5 millimeters. The length L of the basting stitch may be defined as 20 millimeters, for example. Within the range of ordinary revolution speeds of the drive shaft 81 that are used when the stitches of a utility stitch pattern are formed, the maximum value of the unit feed amount for the upper feed device 4 is greater than the length L of basting stitch.

The main processing will be explained with reference to FIG. 6. The main processing is started in a case where the stitch pattern selection screen is displayed on the LCD 15 after the user has started the sewing machine 1. The stitch pattern selection screen is a screen for selecting, from among the plurality of types of the utility stitch patterns, a utility stitch pattern that will be the object of the sewing. When the main processing is started, the sewing object 100 is placed on the bed 11 and is pressed downward by the presser foot 51. The program for performing the main processing is stored in the ROM 62 (refer to FIG. 4) and is executed by the CPU 61. Data that are acquired and computed in the process of the performing of the main processing are stored in the RAM 63 as desired.

Figure 6:
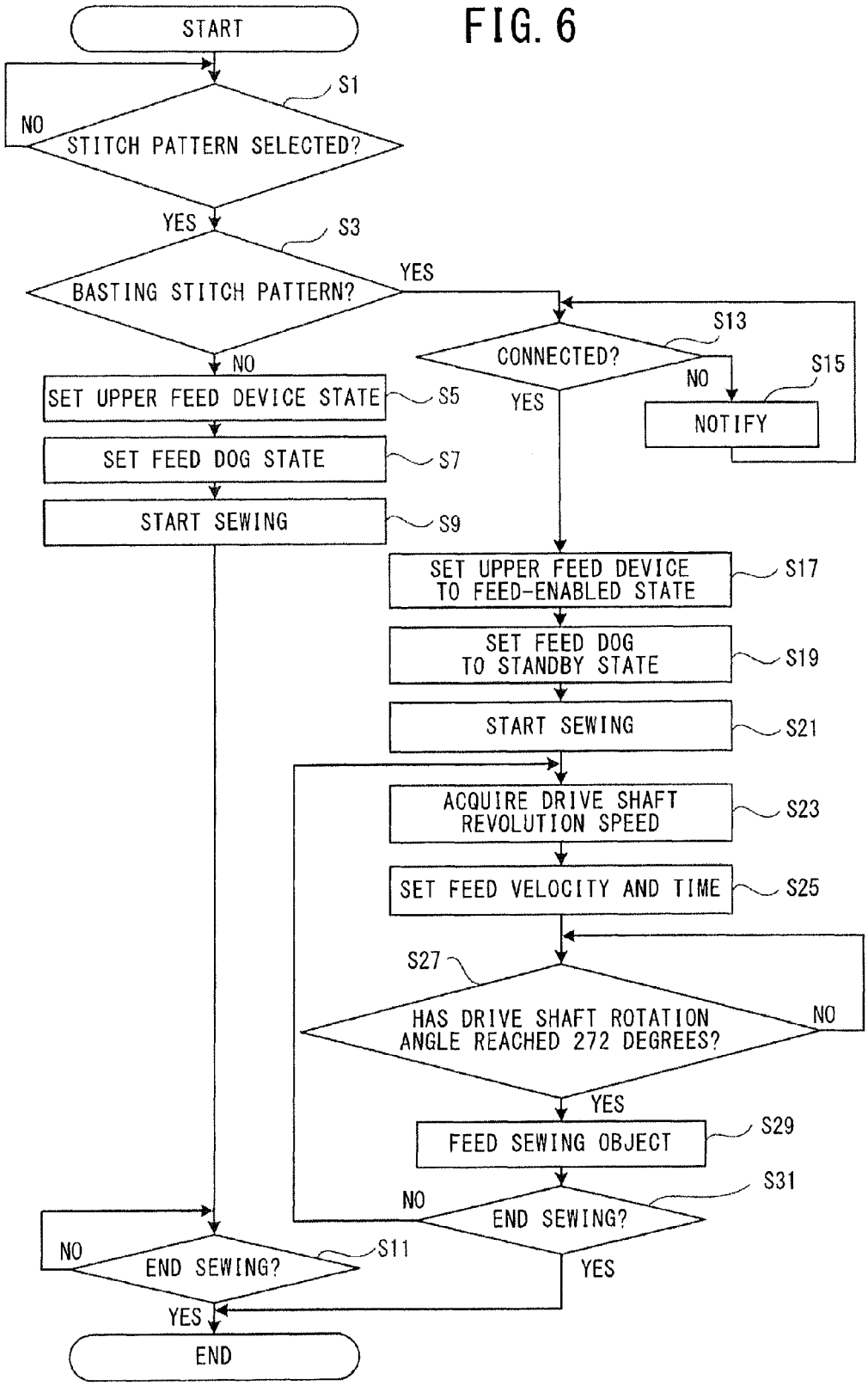
FIG. 6 is a flowchart of main processing.

As shown in FIG. 6, in the main processing, first, the CPU 61 determines whether the utility stitch pattern that will be the object of the sewing has been selected from among the plurality of types of the utility stitch patterns (Step S1). The user performs a panel operation to select the utility stitch pattern that will be the object of the sewing. In a case where the utility stitch pattern that will be the object of the sewing has not been selected (NO at Step S1), the CPU 61 waits until the utility stitch pattern that will be the object of the sewing is selected. In a case where the utility stitch pattern that will be the object of the sewing has been selected (YES at Step S1), the CPU 61 determines whether the utility stitch pattern that was selected by the processing at Step S1 is a basting stitch pattern (Step S3). In a case where the selected utility stitch pattern is not a basting stitch pattern (NO at Step S3), the CPU 61 acquires the stitch pattern data for the utility stitch pattern that was selected by the processing at Step S1 and, in accordance with the acquired stitch pattern data, switches the state of the upper feed device 4 to one of the second standby state and the second feed-enabled state (Step S5). In a case where data that indicate whether the upper feed device 4 will be used or not used are included in the stitch pattern data, the CPU 61 switches the state of the upper feed device 4 in accordance with the setting in the stitch pattern data. In a case where data are stored in a storage device (for example, the flash ROM 64) that indicate a correspondence relationship between the stitch pattern data and the data that indicate whether the upper feed device 4 will be used or not used, the CPU 61 switches the state of the upper feed device 4 in accordance with the correspondence relationship. Next, the CPU 61 sets the state of the feed dog 34 to one of the first standby state and the first feed-enabled state, in accordance with the acquired stitch pattern data (Step S7). In a case where data that indicate whether the feed dog 34 will be used or not used are included in the stitch pattern data, the CPU 61 switches the state of the feed dog 34 in accordance with the setting in the stitch pattern data. In a case where data are stored in a storage device (for example, the flash ROM 64) that indicate a correspondence relationship between the stitch pattern data and the data that indicate whether the feed dog 34 will be used or not used, the CPU 61 switches the state of the feed dog 34 in accordance with the correspondence relationship.

Next, in a case where a command to start the sewing has been input, the CPU 61 starts the sewing (Step S9). The command to start the sewing may be input through the operation switches 21, for example. In a case where a straight line stitch pattern will be sewn using both the upper feed device 4 and the feed dog 34, for example, straight line stitches will be formed in accordance with the stitch pattern data while the sewing object 100 is moved by the upper feed device 4 and the feed dog 34. Next, the CPU 61 determines whether a command to end the sewing has been input (Step S11). The command to end the sewing may be input through the operation switches 21, for example. In a case where a command to end the sewing has not been input (NO at Step S11), the CPU 61 continues the sewing processing. In a case where a command to end the sewing has been input (YES at Step S11), the main processing is terminated.

In a case where the utility stitch pattern that was selected by the processing at Step S1 is a basting stitch pattern (YES at Step S3), the CPU 61 determines that a command to form the basting stitch was acquired by the processing at Step S1. After acquiring the stitch pattern data for the basting stitch pattern, the CPU 61 determines whether the upper feed device 4 is electrically connected to the sewing machine 1 (Step S13). The CPU 61 determines whether the upper feed device 4 is electrically connected to the sewing machine 1 based on the one of the low signal and the high signal that has been output from the previously described connector 39 (refer to FIG. 4). In the processing at Step S13, the CPU 61 determines whether it can control the upper feed device 4. In a case where the upper feed device 4 is not electrically connected to the sewing machine 1 (NO at Step S13), the CPU 61 controls the drive circuit 71 such that information that indicates the determination that was made by the processing at Step S13 is output to the LCD 15 (Step S15). For example, in the processing at Step S15, the message "Please mount the upper feed device" may be displayed on the LCD 15. The message prompts the user to mount the upper feed device 4 on the presser bar 27 of the sewing machine 1 and connect it electrically. When the user mounts the upper feed device 4 on the lower end of the presser bar 27 and connects the connecting portion 52 to the connector 39, in accordance with the message that is displayed on the LCD 15, the signal that is output from the connector 39 switches from the high signal to the low signal. Following the processing at Step S15, the processing returns to Step S13.

In a case where the upper feed device 4 is electrically connected to the sewing machine 1 (YES at Step S13), the CPU 61 outputs to the upper feed device 4 a command that controls the solenoid 53 such that the upper feed device 4 is put into the second feed-enabled state (Step S17). The processing at Step S17 causes the feed mechanism 43 of the upper feed device 4 to come into contact with the sewing object 100 from above. Next, the CPU 61 controls the drive circuit 74 such that it drives the feed dog switching mechanism 86, putting the feed dog 34 into the first standby state (Step S19). The processing at Step S19 puts the feed dog 34 into a state in which it does not move the sewing object 100. Therefore, the processing at Step S17 and the processing at Step S19 put the sewing machine 1 into a state in which the sewing object 100 can be moved only by the upper feed device 4.

Next, in a case where a command to start the sewing has been input, the CPU 61 starts the sewing (Step S21). The command to start the sewing may be input through the operation switches 21, for example. When the sewing is started, the CPU 61 acquires the revolution speed of the drive shaft 81 based on the output from the drive shaft angle sensor 90 (Step S23). Next, the CPU 61 calculates a feed velocity V (mm/sec.) and a feed time T (sec.) for the moving of the sewing object 100 by the upper feed device 4, based on the length of the basting stitch that is indicated by the stitch pattern data for the basting stitch pattern and on the revolution speed of the drive shaft 81 that was acquired at Step S23 (Step S25). For example, assume a case in which the revolution speed of the drive shaft 81 is 150 rpm and the length L of the basting stitch is 20 millimeters. When the sewing object 100 is being moved during the period when the sewing needle 28 is above the sewing object 100, that is, when the rotation angle of the drive shaft 81 is in the range from 272 degrees to 75 degrees, the feed velocity V and the feed time T are computed based on the equations below.

$$\text{Feed time } T=60/150\times(360-272+75)/360\approx 0.18 \text{ (sec.)}$$

$$\text{Feed velocity } V=(\text{length } L \text{ of basting stitch})/(\text{feed time } T)\approx 111 \text{ (mm/sec.)}$$

Next, the CPU 61 monitors the output from the drive shaft angle sensor 90 and determines whether the rotation angle of the drive shaft 81 has reached 272 degrees (Step S27). In a case where the rotation angle of the drive shaft 81 has not reached 272 degrees (NO at Step S27), the CPU 61 waits until the rotation angle of the drive shaft 81 reaches 272 degrees. In a case where the rotation angle of the drive shaft 81 has reached 272 degrees (YES at Step S27), the CPU 61 outputs to the upper feed device 4 a command to operate the upper feed device 4 for the feed time T at the feed velocity V that was set at Step S25, causing the sewing object 100 to be moved (Step S29). The velocity at which the sewing object 100 is moved by the upper feed device 4 is regulated by the revolution speed of the motor 491 of the upper feed device 4. Data that indicate the correspondence relationship between the revolution speed of the motor 491 and the feed velocity for the sewing object are stored in the flash ROM 64. Next, the CPU 61 determines whether a command to end the sewing has been input (Step S31). The command to end the sewing may be input through the operation switches 21, for example. In a case where a command to end the sewing has not been input (NO at Step S31), the CPU 61 continues the sewing processing. In a case where a command to end the sewing has been input (YES at Step S31), the main processing is terminated.

In a case where the sewing machine 1 forms the basting stitch 252, the sewing machine 1 uses the upper feed device 4 to move the sewing object 100. That is, the sewing machine 1 is able to form a basting stitch whose length is greater than the maximum value of the unit feed amount for the feed dog 34, even if it does not use a known needle bar releasing device. The sewing machine 1 is therefore able to form the basting stitch 252 in a shorter time than can a known sewing machine that uses the needle bar releasing device when forming the basting stitch 252. Furthermore, the sewing machine 1 is able to define the feed amount that corresponds to the basting stitch as being the feed amount for which the sewing object can be moved during the period when the needle bar 29, which is moved up and down by the rotation of the drive shaft 81, is above the sewing object.

When the sewing machine 1 forms the basting stitch 252, it puts the feed dog 34 into the first standby state (Step S19), so it can reliably cause the feed dog 34 not to perform the moving of the sewing object 100. Because the sewing machine 1 sets the feed velocity V and the feed time T based on the revolution speed of the drive shaft 81 and the length L of the basting stitch, it is able to form the basting stitch at the specified length. In a case where the upper feed device 4 is not connected to the sewing machine 1, the sewing machine 1, by outputting a message, can prompt the user to put the upper feed device 4 into a state in which it can be used. The sewing machine 1 is able to switch the upper feed device 4 automatically between the second feed-enabled state and the second standby state, in accordance with the stitch pattern data. In a case where the sewing machine 1 will form a basting stitch, the sewing machine 1 is able to put the upper feed device 4 into the second feed-enabled state automatically. It is therefore possible to save the user the time and effort necessary to switch the state of the upper feed device 4 manually or input a separate command for switching the upper feed device 4. The feed mechanism 43 of the upper feed device 4 has a comparatively simple structure in which the main structural elements are the first pulley 433, the second pulley 434, and the belt 435. The sewing machine 1 can easily adjust the unit feed amount for the upper feed device 4 by adjusting the revolution speed of the motor 491.

The sewing machine 1 does not need to be provided with a needle bar releasing device in order to form a basting stitch, so the head 14 can be made more compact, and the cost of the sewing machine 1 can be made lower, than with a sewing machine that is provided with a needle bar releasing device. In the known sewing machine, an operating noise is generated when the needle bar releasing device is operated, but in the sewing machine 1, no operating noise from a needle bar releasing device is generated when a basting stitch is formed.

The sewing machine in the present disclosure is not limited to the embodiment that has been described above, and various types of modifications may be applied within the scope of the present disclosure. For example, the modifications (A) to (F) that are described below may be applied as desired.

(A) the configuration of the sewing machine 1 may be modified as necessary. For example, the present disclosure may also be applied to an industrial sewing machine. To take another example, the upper feed device 4 is removably mounted in the sewing machine 1, but the upper feed device 4 may also be made such that it cannot be removed. As another example, the upper feed device 4 has a configuration in which the sewing object 100 is moved by the belt 435, which is installed around the two pulleys, but the upper feed device 4 is not limited to this configuration. For example, the upper feed device may also have a configuration of the same sort as the feed mechanism 87, which is driven by a drive source that is separate from the sewing machine motor 79. As yet another example, the maximum values for the unit feed amounts of the feed dog 34 and the upper feed device 4 may be changed as desired.

(B) The length of the basting stitch may be modified as desired. In addition to a case in which the length of the basting stitch is set in advance in the stitch pattern data, the length of the basting stitch can be set and modified by the user. To take another example, the basting stitch pattern may be modified as desired. For example, the basting stitch pattern may also be defined such that a stitch that is longer than the maximum value of the unit feed amount for the feed dog 34 and a stitch that is shorter than the maximum value of the unit feed amount for the feed dog 34 are formed in alternation. As another example, the basting stitch pattern may also be defined such that zigzag stitches that include a stitch that is longer than the maximum value of the unit feed amount for the feed dog 34 are sewn in addition to straight line stitches.

(C) In addition to a case in which it is input by a panel operation, a command to form a basting stitch may also be input in a case where an input device other than the touch panel 26, such as a switch, a button, a mouse, or the like, is operated. The information that indicates the determination result from the processing at Step S13 in FIG. 6, as well as the form in which the information is output, may be modified as desired. For example, in a case where the sewing machine 1 is provided with a speaker, the information that indicates the determination result may be output in the form of audio. To take another example, the information that indicates the determination result may be output by switching a display color of a lamp such as an LED or the like.

(D) The configuration and the drive source of the switching mechanism 45 may be modified as desired. For example, the switching mechanism 45 may be operated using a motor as a drive source. The switching mechanism 45 of the upper feed device 4 is able to switch automatically between the second standby state and the second feed-enabled state, but the switching mechanism 45 may also be configured such that the states are switched manually. In a case where the upper feed device 4 has a configuration in which the states are switched manually, the sewing machine 1 may also output information (for example, a message) that prompts the user to manually switch the state of the upper feed device 4 according to whether the upper feed device 4 will be used. This configuration makes it possible for the user to appropriately switch the state of the upper feed device 4 manually in accordance with the information that is output. In a case where the upper feed device 4 will be mounted only when the upper feed device 4 will be used, for example, the switching mechanism 45 may also be omitted. In the same manner, the configuration and the drive source of the feed dog switching mechanism 86 may also be modified as desired. The feed dog switching mechanism 86 is able to switch automatically between the first standby state and the first feed-enabled state, but the feed dog switching mechanism 86 may also be configured such that the states are switched manually.

(E) For the program that includes the commands for performing the main processing in FIG. 6, the method by which the program is acquired, the route by which the program is acquired, and the device in which the program is stored may be modified as desired, as long as the program is stored in a storage device with which the sewing machine 1 is provided by the time that the sewing machine 1 executes the program. Therefore, the program that is executed by the processor with which the sewing machine 1 is provided may be received from another device through one of a cable and wireless communication, and it may also be stored in a storage device such as a flash memory or the like. The other device may be, for example, one of a PC and a server that is connected through a network.

(F) The individual steps of the main processing in FIG. 6 are not limited to the example in which they are performed by the CPU 61, and one of some and all of the steps may also be performed by another electronic device (for example, an ASIC). The individual steps in the processing described above may also be performed by distributed processing by a plurality of electronic devices (for example, a plurality of CPUs). Where necessary, each of the steps in the main processing in the embodiment that is described above may be omitted, new steps may be added, and the order of the steps may be modified. Furthermore, a case in which one of some and all of the actual processing is performed by an operating system (OS) that is operating in the sewing machine 1 based on commands from the CPU 61 with which the sewing machine 1 is provided, and the functions of the embodiment that is described above are implemented by that processing, is included within the scope of the present disclosure.

With regard to modifications to the main processing, the modifications described below, for example, may be applied. In the sewing machine 1, the feed velocity for the sewing object 100 is regulated by the revolution speed of the motor 491. Therefore, the maximum value of the unit feed amount for the upper feed device 4 varies according to the revolution speed of the drive shaft 81. From the standpoint of shortening the sewing time for a single basting stitch whose length is longer than the unit feed amount for the feed dog 34, it is preferable for the maximum value of the unit feed amount for the upper feed device 4 to be not less than the length L of the basting stitch, irrespective of the revolution speed of drive shaft 81. However, in the processing at Step S29, the processing hereinafter described may be performed in a case where, when the revolution speed of the drive shaft 81 is faster than a specified value, the sewing machine 1 cannot set the feed velocity of the upper feed device 4 to the feed velocity V by adjusting the revolution speed of the motor 491 of the upper feed device 4 (a case in which the unit feed amount would exceed the maximum value). For example, the sewing machine 1 may give priority to matching the length of the basting stitch to the value that is prescribed by the stitch pattern data and may reduce the revolution speed of the drive shaft 81 until the feed velocity of the upper feed device 4 can be set to the feed velocity V. As another example, the sewing machine 1 may give priority to the revolution speed of the drive shaft 81 and may set the feed velocity of the upper feed device 4 to its maximum value. In yet another example, in a case where the revolution speed of the drive shaft 81 can be set to a numerical value in advance, the CPU 61 may set the feed velocity V based on the revolution speed that has been set for the drive shaft 81. In addition to being computed, the feed velocity V may also be set based on the actual revolution speed of the drive shaft 81 and on a table in which correspondences between the feed velocity V and the revolution speed of the drive shaft 81 are stored.

What is claimed is:

1. A sewing machine, comprising:

a bed;

a sewing machine motor;

a drive shaft that is configured to be rotated by the sewing machine motor;

a needle bar that is configured to be moved up and down by the rotation of the drive shaft and on a lower end of which a sewing needle is able to be mounted;

a first feed mechanism that, by making contact from below with a sewing object that has been placed on the bed, is able to move the sewing object, the amount for which the sewing object is moved per revolution of the drive shaft in a case where the sewing object is moved in synchronization with the rotation of the drive shaft being a unit feed amount, and a maximum value of the unit feed amount for the first feed mechanism being less than a specified length that is the length of a basting stitch;

a second feed mechanism that, by making contact from above with the sewing object that has been placed on the bed, is able to move the sewing object, a maximum value of the unit feed amount for the second feed mechanism being not less than the specified length; and a control device that is configured to acquire a command to form a basting stitch, and when the control device acquires the command, the control device controls the first feed mechanism such that the first feed mechanism does not perform moving of the sewing object and controls the second feed mechanism such that the second feed mechanism performs moving of the sewing object in synchronization with the rotation of the drive shaft, with the specified length being defined as the unit feed amount.

2. The sewing machine according to claim 1, further comprising:

a first switching mechanism that is able to switch the first feed mechanism between a first feed-enabled state that is a state in which the first feed mechanism is able to move the sewing object and a first standby state that is a state in which the first feed mechanism does not move the sewing object, wherein when the control device acquires the command, the control device controls the first switching mechanism such that the first feed mechanism is switched to the first standby state.

3. The sewing machine according to claim 1, when the control device acquires the command, the control device sets a feed velocity at which the sewing object is moved by the second feed mechanism, based on a revolution speed of the drive shaft and on the specified length, and controls the second feed mechanism such that the second feed mechanism moves the sewing object at the feed velocity that has been set.

4. The sewing machine according to claim 1, wherein when the control device acquires the command, the control device determines whether the control device is able to control the second feed mechanism and, when it determines that the control device is not able to control the second feed mechanism, outputs information that indicates the determination result.

5. The sewing machine according to claim 1, further comprising:

a second switching mechanism that is able to switch the second feed mechanism between a second feed-enabled state that is a state in which the second feed mechanism is able to move the sewing object and a second standby state that is a state in which the second feed mechanism does not move the sewing object, wherein when the control device acquires the command, the control device controls the second switching mechanism such that the second feed mechanism is switched to the second feed-enabled state.

6. The sewing machine according to claim 1, wherein the second feed mechanism includes a motor, a first pulley that is configured to rotate in conjunction with the turning of the motor, a second pulley that is disposed in a position that is set apart from the first pulley, and a belt that is installed around the first pulley and the second pulley and that is configured to be moved in conjunction with the rotating of the first pulley, and the second feed mechanism is configured such that the second feed mechanism moves the sewing object by operating the motor in a state in which a portion of the belt has come into contact with the sewing object from above.

* * * * *